United States Patent [19]

Kandler et al.

[11] 4,093,538

[45] June 6, 1978

[54] PROCESS FOR INHIBITING THE CORROSION OF HEAVY PULPS FOR HEAVY MEDIA SEPARATION OF MINERALS

[75] Inventors: Joachim Kandler, Erftstadt Lechenich; Klaus Komorniczyk, Kerpen; Mathias Reitz, Cologne, all of Germany

[73] Assignee: Hoechst Aktiengesellschaft, Frankfurt am Main, Germany

[21] Appl. No.: 607,013

[22] Filed: Aug. 22, 1975

[30] Foreign Application Priority Data

Aug. 28, 1974 Germany ..... 2441096

[51] Int. Cl.[2] ..... B03B 5/30

[52] U.S. Cl. ..... 209/172.5; 252/60

[58] Field of Search ..... 209/172.5; 252/389 A, 252/60

[56] References Cited

U.S. PATENT DOCUMENTS

| | | | |
|---|---|---|---|
| 2,206,980 | 7/1940 | Wade | 209/172.5 |
| 2,393,160 | 1/1946 | Marder | 209/172.5 |
| 2,774,734 | 12/1956 | Rodis | 209/172.5 X |
| 2,991,878 | 7/1961 | Gary | 209/172.5 X |
| 3,325,567 | 6/1967 | Le Sues | 252/389 A |
| 3,502,748 | 3/1970 | Beisworth | 252/389 A X |
| 3,933,427 | 1/1976 | Rohnsack | 252/389 A X |
| 3,935,125 | 1/1976 | Jacob | 252/389 A |
| 3,943,061 | 3/1976 | Cziska | 209/172.5 X |

*Primary Examiner*—Robert Halper
*Attorney, Agent, or Firm*—Connolly and Hutz

[57] ABSTRACT

The corrosion of aqueous heavy pulps which contain ferrosilicon with between 8 and 20 weight % of silicon as a heavy medium and are used in the heavy media separation of minerals is inhibited. To this end, the heavy pulp is used in admixture with between 0.1 and 0.8 weight % of a carboxy-alkane-phosphonic acid of the following formulae:

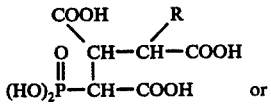

or

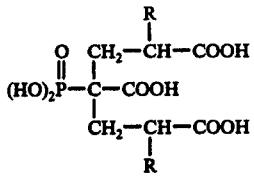

in which R stands for hydrogen or alkyl having from 1 to 4 carbon atoms, or

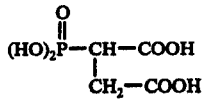

or

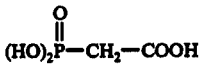

or

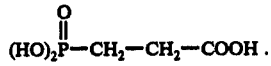

1 Claim, No Drawings

PROCESS FOR INHIBITING THE CORROSION OF HEAVY PULPS FOR HEAVY MEDIA SEPARATION OF MINERALS

It is known that ferromagnetic heavy pulps or aqueous suspensions for use in the heavy media separation of minerals, especially ores, have to meet certain specifications which are necessary to ensure reliable separation according to specific densities. Factors, which critically determine the separation under commercially attractive conditions, are the shape of the individual particles, the particle size distribution, the specific density of the ferromagnetic powders, and their susceptibility to corrosion in aqueous suspension.

As regards corrosion, ferromagnetic powders behave differently in aqueous medium, depending on their chemical composition, preparation and particle size distribution. The susceptibility of heavy pulps to corrosion is inter alia promoted by the use of acid mine water and pulp circulation pumps rotating at extremely high speed. This causes the individual particles to be broken up into edged material which is highly susceptible to corrosion. Ferromagnetic powders are also likely to effect the formation of corrosive centers in all those cases in which the walls of the pulp conveying pipes or the individual particles are subject to abrasion. Upon the occurrence of corrosion phenomena in a ferromagnetic pulp, hydrogen is evolved which may culminate in oxyhydrogen explosions. To avoid this, it is necessary for the susceptibility to corrosion of heavy pulps to be minimized. A further adverse phenomenon resides in the fact that oxides having a density lower than that of the ferromagnetic powder are being increasingly formed as the corrosion proceeds, whereby the specific density of the powder is naturally reduced. In other words, it is necessary by the continuous addition of heavy medium to the pulp to provide for a constant density which ensures effective separation of minerals. The above reduction in density of the pulp can in fact be equalized, though not, however, more than up to a certain limit volume of solid material. A pulp containing more heavy medium than corresponds to that limit volume is so extremely viscous that it is useless for the separation of material therein. In seeking to avoid the above adverse effects, we have now found that carboxy-alkane phosphonic acids are very useful corrosion inhibitors. In aqueous ferromagnetic heavy pulps containing ferrosilicon with between 8 and 20 weight % of Si, they enable the phenomenon of corrosion to be substantially inihibited, and in pulps in which corrosion has in fact occurred, they enable the spreading out of the corrosion to be stopped.

The present invention relates more particularly to a process for inhibiting the corrosion in aqueous heavy pulps containing ferrosilicon with between 8 and 20 weight % of silicon as the heavy medium and being used for the heavy media separation of minerals, which comprises using the heavy pulp in admixture with between 0.1 and 0.8 weight % of a carboxy-alkane phosphonic acid of the following formulae:

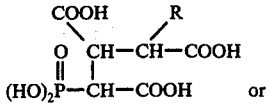

or

-continued

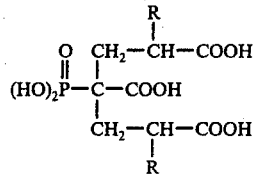

in which formulae R stands for hydrogen or alkyl having from 1 to 4 carbon atoms, or

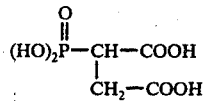

or

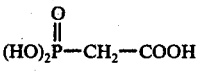

or

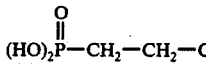

The above tricarboxy-alkane phosphonic acids can be made, e.g. by the process described in U.S. Patent Applications Ser. No. 481 809 filed June 21, 1974.

Preparation of 1,3,5-tricarboxy-pentane-3-phosphonic acid.

0.2 mol of sodium methylate in 15 cc of methanol was added dropwise within 20 minutes to a mixture of 136.5 g (0.75 mol) of carbomethoxy-methane-phosphonic acid dimethyl ester and 138 g (1.6 mols) of methyl acrylate. Despite the fact that the reaction mixture was effectively cooled from the outside with a $CO_2$/acetone mixture, the temperature increased to about 100° C. The whole was allowed to further react at that temperature for 30 minutes and the resulting 1,3,5-tricarbomethoxy-pentane-3-phosphonic acid dimethyl ester was separated by fractional distillation under vacuum. $bp_{0.9}$: 197°–202° C yield: 236 g (89% of theoretical) $n^{25}_D$ = 1.4633

| Analysis: | P | C | H |
|---|---|---|---|
| Found (%): | 8.8 | 44.2 | 6.7 |
| Calculated (%): | 8.8 | 44.1 | 6.5 |

The ester thus obtained was heated to 150° C. Dry hydrogen chloride gas was introduced thereinto over a period of 24 hours and the ester was thereby completely hydrolyzed to the free acid. Methyl chloride and HCl gas in excess were permitted to escape.

Preparation of 1,2,3-tricarboxy-propane-1-phosphonic acid.

0.09 mol of sodium methylate in 25 cc of methanol was added within 45 minutes to a mixture of 136.5 g (0.75 mol) of carbomethoxy-methane-phosphonic acid dimethyl ester and 108 g (0.75 mol) of dimethyl maleate. The temperature was found to increase from 22° C to 41° C. The whole was allowed to further react for 30 minutes at 100° C. After neutralization by the addition of 5 cc of concentrated hydrochloric acid and filtration, all volatile matter was distilled off under vacuum at a base temperature up to 120° C. 1,2,3-tricarbomethoxy-propane-1-phosphonic acid dimethyl ester was obtained in a crude yield of 237 g (97% of the theoretical). The ester had a boiling point of 169°–172° C under 0.7 mm of mercury. $n^{25}_D$ = 1.4520.

| Analysis: | P | C | H |
|---|---|---|---|
| Found (%): | 9.4 | 40.0 | 6.2 |
| Calculated (%): | 9.5 | 40.5 | 5.8 |

The ester thus obtained and 100 cc of concentrated hydrochloric acid were heated to boiling temperature (which increased from 75° to 105° C) while methyl chloride and methanol originating from the hydrolysis were distilled off. After the hydrolysis was complete, the reaction solution was evaporated under vacuum to dryness (maximum base temperature = 120° C) and diluted with water so as to obtain a solution of 50% strength.

Description of the testing method.

The ferromagnetic heavy medium and the aqueous phase, which is to be tested for corrosion, are made into suspensions having a density of 3.0 and 3.5 kg/1. The quantity of hydrogen evolved is the lower the lower the density of the pulp. 350 cc of suspension are heated for a period of up to 96 hours to 80° C under reflux, and the quantity of hydrogen evolved during the heating period is identified. After termination of the experiment, the ferromagnetic heavy medium is separated and dried, and the reduction in specific density is identified. It is customary for the corrosion tests to be made in an acid acetate-buffered medium, in view of the fact that ferromagnetic heavy pulps are extremely susceptible to corrosion within that pH-range.

Test results:

EXAMPLE 1:

The product tested was commercial ferrosilicon with 15 weight % of Si, produced by atomizing a melt.

The product had the following particle size distribution, in wt.%:

| | |
|---|---|
| >0.200 mm: | 4.1 |
| >0.160 mm: | 12.1 |
| >0.100 mm: | 32.6 |
| >0.063 mm: | 48.3 |
| <0.063 mm: | 51.7 |
| Pycnometer density: | 6.68 g/cc |
| Aqueous solution: | acetate buffer; pH: 4.62 |
| Pulp density: | 3.5 g/cc |

| | None | Addend 0.6 wt.% of 1,3,5-tricarboxy-pentane-3-phosphonic acid, based on heavy pulp |
|---|---|---|
| Hydrogen evolved after 96 hours | 5 450 cc | 1850 cc |
| Pyconometer density after corrosion test | 6.52 g/cc | 6.60 g/cc |

EXAMPLE 2:

The product tested was commercial ferrosilicon with 15 wt.% of Si, produced by crushing and milling cold ingots.

The product had the following particle size distribution, in wt.%:

| | |
|---|---|
| >0.160 mm: | 0.0 |
| >0.100 mm: | 4.8 |
| >0.063 mm: | 25.0 |
| <0.063 mm: | 75.0 |
| Pycnometer density: | 6.62 g/cc |
| Aqueous solution: | Acetate buffer; pH: 4.62 |
| Pulp density: | 3.0 g/cc |

-continued

| | None | Addend 0.6 wt.% of 1,3,5-tricarboxy-pentane-3-phosphonic acid, based on heavy pulp |
|---|---|---|
| Hydrogen evolved after 96 hours | 44 150 cc | 1700 cc |
| Pycnometer density after corrosion test | 5.39 g/cc | 6.55 g/cc |

EXAMPLE 3:

The product, particle size distribution, pycnometer density, acetate buffer, and pulp density were the same as described in Example 2.

Three tests were made which were interrupted after 20 hours.

| | Test 1 | Test 2 | Test 3 |
|---|---|---|---|
| Hydrogen evolved after 20 hours: | 28 200 cc | 27 300 cc | 28 600 cc |

To inhibit corrosion, the material used in tests 2 and 3 was mixed with 1,3,5-tricarboxy-pentane-3-phosphonic acid, and the corrosion tests were resumed.

| | Test 1 | Test 2 | Test 3 |
|---|---|---|---|
| | None | Addend 0.1 wt.% | 0.4 wt.% |
| Gas evolved after altogether 96 hours | 55 100 cc | 37 800 cc | 33 500 cc |
| Pycnometer density after corrosion test | 5.21 g/c | 5.48 g/cc | 5.50 g/cc |

EXAMPLE 4:

The product was the same as that used in Example 1. Particle size distribution, in wt.%:

| | |
|---|---|
| >0.160 mm: | 0.0 |
| >0.100 mm: | 1.0 |
| >0.063 mm: | 17 |
| <0.063 mm: | 83 |
| Pycnometer density: | 6.81 g/cc |
| Aqueous solution: | acetate buffer; pH:4.62 |
| Pulp density: | 3.5 g/cc |

| | None | Addend 0.2 wt.% of 1,3,5-tricarboxy-pentane-3-phosphonic acid, based on heavy pulp |
|---|---|---|
| Gas evolved after 96 hours | 2 100 cc | 1 400 cc |
| Pycnometer density after corrosion test | 6.70 g/cc | 6.71 g/cc |

EXAMPLE 5:

The product tested was the same as that described in Example 2.

Particle size distribution, in wt.%:

| | |
|---|---|
| >0.160 mm: | 1.4 |
| >0.100 mm: | 14.5 |
| >0.063 mm: | 47.6 |
| <0.063 mm: | 52.4 |
| Pycnometer density. | 6.71 g/cc |
| Aqueous solution: | buffer solution; pH: 8.00 |
| Pulp density: | 3.0 g/cc. |

| | None | Addend 0.1 wt.% of 1,3,5-tricarboxy-pentane-3-phosphonic acid, |
|---|---|---|

-continued

| | | based on heavy pulp |
|---|---|---|
| Gas evolved after 96 hours | 33 400 cc | 1 100 cc |
| Pycnometer density after corrosion test | 6.22 g/cc | 6.64 g/cc |

EXAMPLE 6:

Product, particle size distribution, pycnometer density and pulp density were as described in Example 2.

Aqueous solution: a) acetate buffer; pH: 4.62

| | Addend | |
|---|---|---|
| | None | 0.6 wt.% of 1,2,3-tricarboxy-propane-1-phosphonic acid, based on heavy pulp |
| Gas evolved after 25 hours | 31 100 cc | 5 400 cc |
| Pycnometer density after corrosion test | 5.71 g/cc | 6.34 g/cc |

Aqueous solution: b) buffer solution; pH: 8.0

| | Addend | |
|---|---|---|
| | None | 0.6 wt.% of 1,2,3-tricarboxy-propane-1-phosphonic acid, based on heavy pulp |
| Gas evolved after 25 hours | 11 350 cc | 400 cc |
| Pycnometer density after corrosion test | 6.22 g/cc | 6.50 g/cc |

EXAMPLE 7:

Product, particle size distribution, pycnometer density and pulp density were as described in Example 5.

Aqueous solution: acetate buffer; pH: 4.62.

| | Addend | |
|---|---|---|
| | None | 0.6 wt.% of 1,2-dicarboxy-ethane-1-phosphonic acid (phosphonosuccinic acid), based on heavy pulp |
| Hydrogen evolved after 44 hours | 48 920 cc | 700 cc |
| Pycnometer density after corrosion test | 5.48 g/cc | 6.67 g/cc |

EXAMPLE 8:

Example 7 was repeated but carboxy-methane-phosphonic acid was substituted for 1,2-dicarboxy-ethane-1-phosphonic acid.

| | Addend | |
|---|---|---|
| | None | 0.4 wt.% of carboxy-methane-phosphonic acid, based on heavy pulp |
| Hydrogen evolved after 44 hours | 48 920 cc | 10 580 cc |
| Pycnometer density after corrosion test | 5.48 g/cc | 6.30 g/cc |

EXAMPLE 9:

Example 7 was repeated but increasing quantities of 2-carboxy-ethane-1-phosphonic acid were substituted for 1,2-dicarboxy-ethane-1-phosphonic acid.

| | Addend | | | | |
|---|---|---|---|---|---|
| | None | 0.2 | 0.4 | 0.6 | 0.8 |
| | | wt.% of 2-carboxy-ethane-1-phosphonic acid (phosphono-propionic acid), based on heavy pulp | | | |
| Gas evolved after 67 hours | 67 700 cc | 12 850 cc | 9 750 cc | 8 600 cc | 8 550 cc |
| Pycnometer density after corrosion test | 5.30 g/cc | 6.20 g/cc | 6.32 g/cc | 6.30 g/cc | 6.30 g/cc |

We claim:

1. A process for inhibiting the corrosion of aqueous heavy pulps containing ferrosilicon with between 8 and 20 weight % of silicon therein as a heavy medium and being used in the heavy media separation of minerals, wherein the heavy pulp is used in admixture with between 0.1 and 0.8 weight % of a carboxy-alkane-phosphonic acid being selected from acids having one of the following formulae:

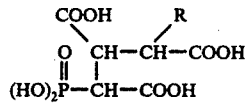

1)

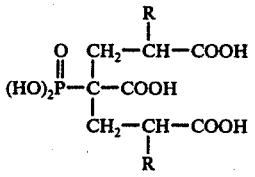

2)

in which R stands for hydrogen or alkyl having from 1 to 4 carbon atoms,

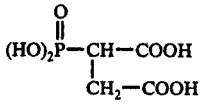

3)

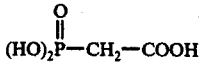

4)

and

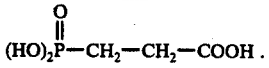

5)

* * * * *